United States Patent [19]

Bonne et al.

[11] 4,251,025

[45] Feb. 17, 1981

[54] FURNACE CONTROL USING INDUCED DRAFT BLOWER AND EXHAUST STACK FLOW RATE SENSING

[75] Inventors: Ulrich Bonne; Lorne W. Nelson; Ralph H. Torborg, all of Hennepin, Minn.

[73] Assignee: Honeywell Inc., Minneapolis, Minn.

[21] Appl. No.: 57,051

[22] Filed: Jul. 12, 1979

[51] Int. Cl.[3] ..... F23N 1/00; F23N 1/08

[52] U.S. Cl. ..... 236/14; 236/15 BD; 431/12

[58] Field of Search ..... 236/14, 15 BD; 431/12

[56] References Cited

U.S. PATENT DOCUMENTS

| | | | |
|---|---|---|---|
| 1,174,003 | 2/1916 | Gibson | 236/14 X |
| 1,363,513 | 12/1920 | Keith | 236/14 X |
| 1,721,800 | 5/1929 | Wunsch | 236/14 |
| 2,332,580 | 10/1943 | Klinker | 236/14 |
| 3,096,020 | 7/1963 | Kraft | 236/14 |
| 4,097,219 | 6/1978 | Prowald | 236/15 BD |

*Primary Examiner*—William E. Wayner

*Assistant Examiner*—Harry Tanner

*Attorney, Agent, or Firm*—Clyde C. Blinn

[57] ABSTRACT

Apparatus is provided for constructing an induced draft furnace and its control system, to produce an induced draft furnace having increased efficiency. A blower located in the furnace exhaust stack is used to induce movement of air, fuel and combustion products into, through and out of the combustion chamber. A flow-limiting orifice in the exhaust stack in proximity to the blower causes a region of higher pressure to exist upstream from the orifice, with a region of lower pressure downstream from the orifice. A pressure signal representative of the flow rate of exhaust stack gases is sensed on one side of the orifice and is fed back to a modulating gas valve which controls the outlet gas flow from the valve to be proportional to the magnitude of the pressure signal representing exhaust stack flow rate. By selecting blower speeds and flow capacities, various firing rates for the furnace can be selected, from the design maximum of the furnace down to various derated levels.

12 Claims, 8 Drawing Figures

FURNACE CONTROL USING INDUCED DRAFT BLOWER AND EXHAUST STACK FLOW RATE SENSING

BACKGROUND OF THE INVENTION

1. Field of the Invention

This invention relates to combustion heating systems and control apparatus for such systems. More specifically, this invention relates to apparatus for constructing a furnace and its control system, to produce an induced draft furnace having increased efficiency.

2. Description of the Prior Art

Conventional gas-fired, natural draft furnace systems typically operate at a steady-state efficiency of about 75%. The seasonal average efficiency of such furnace systems is usually considerably lower, on the order of 60%. As the cost of gas and other fuels used for heating rises, and as such fuels grow scarcer, these levels of efficiency are considered less and less acceptable, and various ways of increasing furnace system efficiency are sought.

Several methods of increasing furnace efficiency are known in the prior art. For example, it is known that significant efficiency-reducing losses occur due to the escape of heat up the flue, vent, or exhaust stack during the portion of the furnace cycle when the burner is off. This heat is primarily heat taken from the burner heat exchanger following a burning cycle. One prior art solution to this form of heat loss is to provide dampers of various kinds which permit draft flow when required for the burning cycle, but serve to limit draft flow when the burner is not on. Examples of such dampers may be seen in the following U.S. Pat. Nos. 1,743,731; 1,773,585; 2,011,754; 2,218,930; 2,296,410; 4,017,027 and 4,108,369. As these patents show, a damper having the desired effect can be placed so as to limit exhaust draft flow out of the combustion chamber or input air flow into the combustion chamber.

A second form of efficiency-reducing loss in furnaces occurs due to inefficient burning as a result of improper air-fuel ratio. The prior art shows several methods for controlling fuel and/or air flow in order to maintain the air-fuel ratio as close as possible to the chemical ideal of stoichiometric burning, in which all fuel and oxygen would be completely combusted. Such prior art arrangements include U.S. Pat. No. 3,280,774, which shows an orifice plate of pre-selected cross-section and draft-limiting characteristics combined with a draft blower fan, and U.S. Pat. No. 2,296,410, which shows an apparatus for mechanically linking a modulating fuel regulator to a draft damper, to regulate the air supply in relation to the fuel supply.

A third form of efficiency-reducing loss in furnaces occurs due to the heat exchange process. Because it is impossible to transfer all the heat from the combustion chamber to the circulated air, water or other heat delivery medium, a certain amount of unabsorbed heat passes out of the heat exchanger and up the exhaust stack. One known way of reducing this type of loss is to derate the furnace, i.e., operate it at a lower firing rate. This permits a higher percentage of the heat produced by combustion to be absorbed in the heat exchanger. An example of a prior art patent disclosing a burner using derating is U.S. Pat. No. 3,869,243.

There are, however, certain disadvantages which may accompany a reduced firing rate. In particular, the following may arise: (1) slower response time in reaching the thermostatically selected room temperature; (2) possible inability to achieve the selected temperature; (3) increased condensation on the inside walls of the furnace chamber, or the interiors of tubing, valves, etc., associated with the furnace, leading to more rapid corrosion, rusting or other deterioration of such parts; and (4) mismatching of fuel and air ratios, often leading to high excess air conditions at firing rates below the design maximum.

SUMMARY OF THE INVENTION

The present invention provides apparatus for constructing an induced draft combustion apparatus and its associated control system, to produce an induced draft furnace having increased efficiency. With the present invention, a blower located in the exhaust stack or vent is used to induce the movement of air and combustion products into, through and out of the combustion chamber. A flow-restricting orifice means in the exhaust stack in proximity to the blower causes a region of higher pressure to exist upstream from the orifice with a region of lower pressure downstream from the orifice. A pressure signal representative of the exhaust stack flow rate is sensed on one side of the orifice and is fed back to a modulating gas valve which controls the outlet gas flow from the valve to be proportional to the magnitude of the exhaust stack flow rate. By selecting blower speeds and flow capacities, various firing rates for the furnace can be selected, from the design maximum down to various derated levels.

Additional features which can be used to enhance the present invention include a two-stage thermostat control system which provides two different firing rates and safety switches for shutting off gas when the stack is blocked or the outlet gas pressure is insufficient. If a conduit is used to communicate the sensed stack pressure back to the modulating gas valve, means for flushing the conduit to reduce the possibility of condensation, corrosion or blockage can be provided.

The principal objects of the present invention are to provide an improved furnace or heating apparatus design and control system which: (a) provides improved steady-state and seasonal efficiency as compared to conventional natural draft furnaces; (b) utilizes an induced draft blower and a stack flow rate feedback signal to control burner fuel flow proportional to the stack flow rate; (c) utilizes stack pressure as a means of determining stack flow rate and as a feedback signal; (d) provides a means for derating a furnace for increased efficiency; (e) provides a two-stage control system for operating a furnace at a higher and a lower firing rate; (f) provides a two-stage control system for operating a derated furnace without increasing condensation and consequent corrosion; (g) provides a two-stage control system for ensuring that a derated furnace can achieve desired room temperatures and reach them without excessive delay; and (h) provides safety devices to shut off gas when the exhaust stack is blocked or when outlet gas pressure is insufficient.

BRIEF DESCRIPTION OF THE DRAWINGS

In the accompanying drawings forming a material part of this disclosure.

DESCRIPTION OF THE INVENTION

Figure 1:
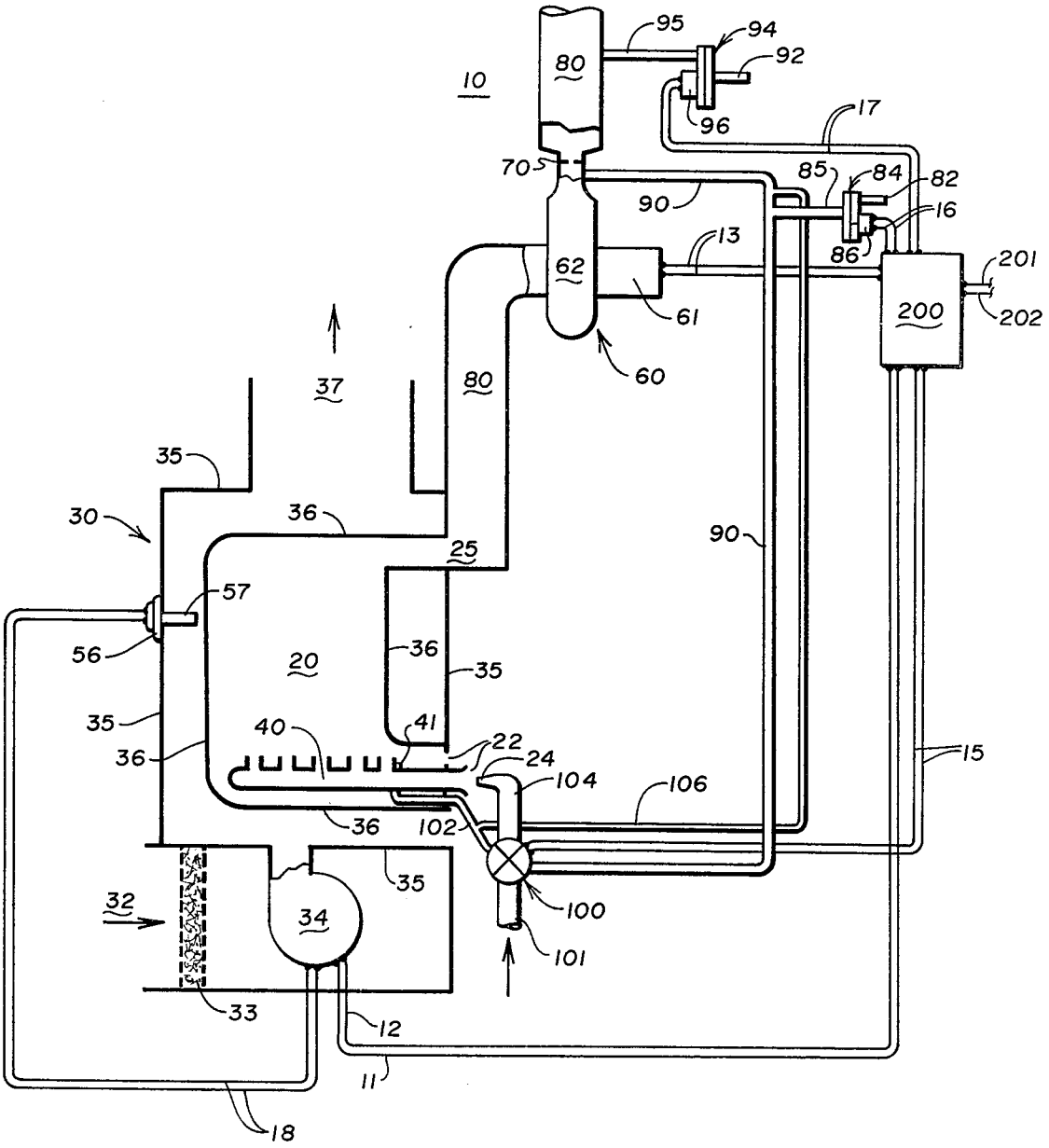
FIG. 1 is a schematic drawing of the furnace and control system of the present invention, using an orifice downstream from the induced draft blower and using positive pressure feedback.

Description of Preferred and Alternate Embodiments a. General Configuration of Furnace and Control System A furnace and furnace control system 10 in accordance with the present invention consists generally, as shown in FIG. 1, of one or more combustion chambers 20, each of which has a burner 40 located near its bottom and is substantially enclosed by exterior walls 36. Fuel, which in the preferred embodiment is a gas such as natural gas or liquified petroleum, is fed to the burner 40 by a gas outlet 24 near the mouth of the burner 40. Air enters the burner 40 and the combustion chamber 20 at air inlets 22, located near the tip of the gas outlet 24 and the mouth of the burner 40. A pilot flame 41 positioned immediately adjacent the burner 40 is used to ignite it.

Surrounding the combustion chamber (or chambers) 20 is a heat exchanger 30 with its interior boundary being formed by the exterior walls 36 of the combustion chamber 20 and its exterior boundary being formed by the walls 35. Thus two separate fluid paths are formed. The combustion chamber path leads from the gas outlet 24 and air inlets 22 through the burner 40 and out the flue 25. The heat exchanger path follows the exterior walls 36 of the combustion chamber 20, with the fluid to be heated entering below the burner 40, proceeding along the vertical portion of the enclosed area between the walls 35 and the exterior burner wall 36 to exit above the combustion chamber 20. While in the preferred embodiment air is the fluid to be heated, other fluids, such as water, may also be used with minor design changes.

As is conventional, movement of air into and through the heat exchanger 30 is provided by a fan 34 driven by an electric motor 38 (not shown in FIG. 1). Cold air is pulled into the heat exhanger 30 at a cold air return duct 32 and passes through an air filter 33 before it enters the fan 34. The fan 34 drives the air into the heat exchanger 30 through an opening in its bottom wall. Heated air passes out of the heat exchanger 30 through a warm air duct 37, which extends from an opening in the top wall of the heat exchanger 30.

With the exception of the flue 25 and the combustion air inlets 22 adjacent the gas outlet 24, the combustion chamber 20 is enclosed and substantially air-tight. Accordingly, the only exit for combustion materials is provided by the flue 25. In order to induce air to enter the combustion chamber 20 at the combustion air inlets 22 and to induce combusted gases to exit from the combustion chamber 20 and flow out the flue 25 and exhaust stack or vent 80, an induced draft blower 60 is used. This induced draft blower 60, with its electric motor 61 and fan blades 62, is located in line with the flue 25 and the exhaust stack or vent 80. Electric power is supplied to the motor 61 by a line voltage source, indicated by wires 13. The blower 60 may be single or multiple speed, depending on the type of control system with which it is to be used. While blowers of various specifications may be used, in the preferred embodiment the blower 60 is single-speed, is powered by 120 volts a.c. and produces 1 inch W.C. minimum pressure (relative to atmosphere) at 450 degrees Fahrenheit, at a flow rate of about 50 c.f.m.

A fluid fuel, preferably natural gas or liquified petroleum, is provided to the burner 40 at the gas outlet 24, fed by the outlet pipe 104 of a modulating gas valve 100, which serves as a primary element of a fuel supply control means. Gas from a supply maintained at line pressure enters the gas valve 100 at a gas inlet pipe 101. Gas regulated to the desired outlet pressure flows out of the gas valve 100 through the outlet pipe 104. The pilot flame 41 is supplied with gas at line pressure by a smaller outlet pipe 102. The detailed structure and operation of the gas valve 100 which permits it to regulate gas to the desired pressure is described below.

FIG. 1 also shows in a general, schematic manner, the interconnections between the various components forming the furnace control system. Coordination of the control system is provided by a thermostatic control 200 which includes various temperature-sensitive components and switching elements, as will be described in greater detail below in connection with FIGS. 4 and 5. These components and switching elements serve as the means for controlling operation of the blower 60 and for enabling the gas valve 100. Power to the thermostatic control 200 is provided by connections to a line voltage source, indicated by wires 201, 202.

Figure 2A:
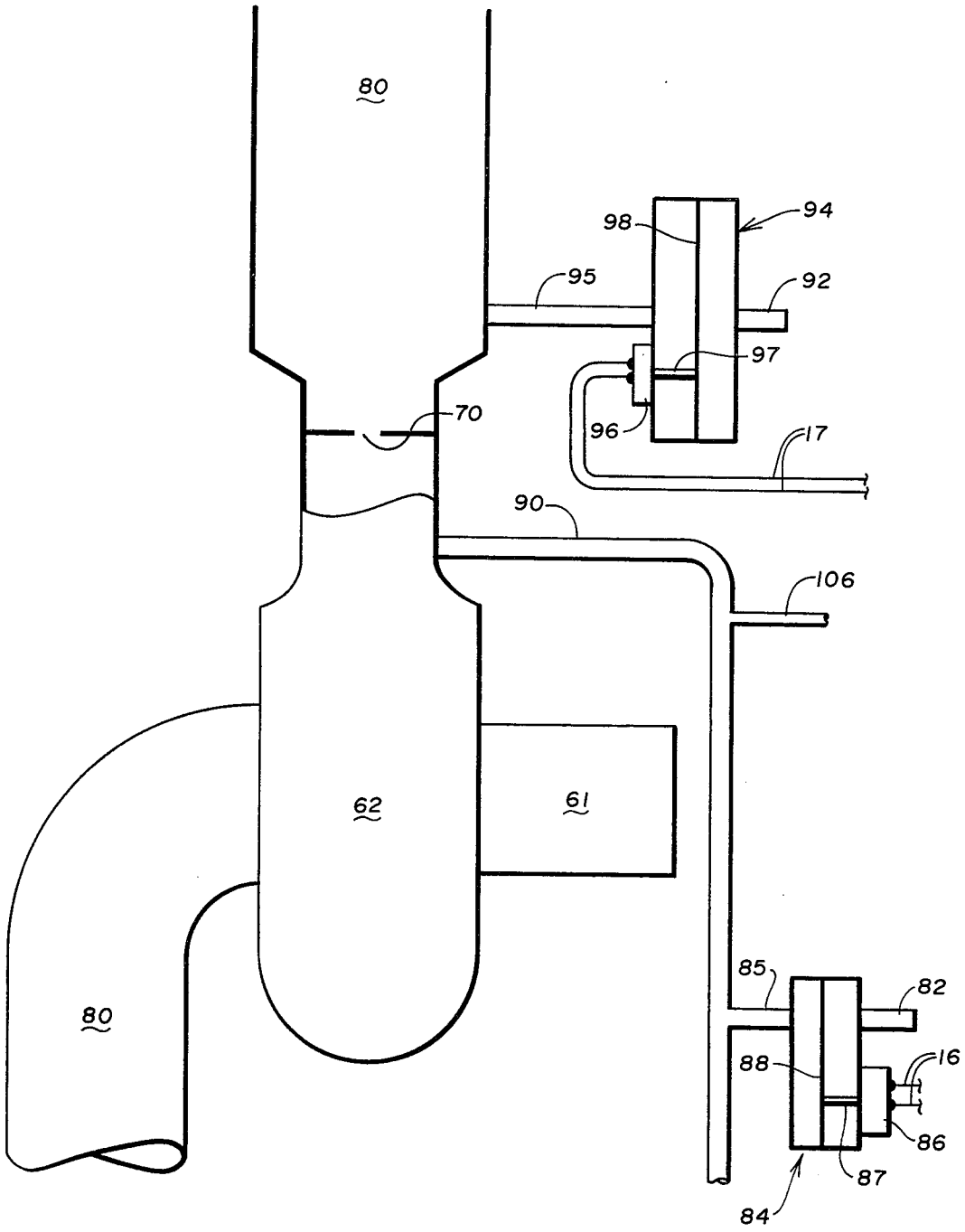
FIG. 2*a* is a detail of the induced draft blower, exhaust stack and pressure sensing components of the invention shown in FIG. 1.

The thermostatic control 200 is electrically connected, via wires 16, to a first differential pressure switch 86, which is actuated by a differential pressure sensor 84. Referring now also to FIG. 2*a*, one input to the differential pressure sensor 84 is provided by a conduit 85 which connects one side of the differential pressure sensor 84 to a conduit 90 which, in turn, is connected to the gas valve 100 and to a pressure region in the exhaust stack 80. In the preferred embodiment shown in FIG. 1, this region is located downstream from the induced draft blower 60 and upstream from a flow-limiting restriction, preferably a stack orifice 70, which is also located downstream of the blower 60. The pressure in this region near the orifice 70 will hereinafter be referred to as the "feedback pressure." The second input to the differential pressure sensor 84 is provided by a conduit 82 which communicates with the other side of the differential pressure sensor 84. The pressure in conduit 82 is derived from the furnace system's ambient atmosphere. This pressure will hereinafter be referred to as the "atmospheric reference pressure." Referring now to FIG. 2*a*, as is conventional in such pressure sensors, the pressure differential, which corresponds to mass flow in the exhaust stack 80, affects the position of a diaphragm 88 which, in turn, through an actuator rod 87, causes the switch 86 to change state when a predetermined pressure differential (e.g., 0.85 inches W.C.) exists. This change of state in the switch 86 causes one circuit path to be opened while another is simultaneously closed. (Due to inherent hysteresis, the switch 86 will actually change state at two somewhat different predetermined values, depending on whether the pressure differential is increasing or decreasing.)

Referring still to FIG. 1, a feedback conduit 90 which is connected to and through the wall of the stack 80 communicates a stack pressure sensed at the point of connection back to the modulating gas valve 100. As is described below, it is this pressure feedback signal, communicated via the conduit 90, which is used to modulate the outlet gas pressure and, thus, the fuel flow rate, from the valve 100. In the preferred embodiment of the invention, shown in FIGS. 1 and 2*a*, the connection of the conduit 90 to the stack 80 is at a point just upstream from an orifice 70, which is, in turn, downstream from the blower 60. In an alternative embodiment, shown in FIG. 2*b*, the orifice 70*b* is located upstream from the blower 60, but the connection of the conduit 90 to the stack 80 is at a point just downstream from the orifice 70*b*. It will be seen that when the blower 60 is in operation the pressure communicated by the conduit 90 will be greater than atmospheric (positive pressure) in the case of the preferred embodiment (FIGS. 1 and 2*a*), while the pressure communicated in the case of the alternative embodiment (FIG. 2*b*) will be less than atmospheric (negative or suction pressure).

The thermostatic control 200 is also electrically connected to the motor 61 of the stack blower 60 via wires 13. As is described in greater detail below, it is this connection which permits the thermostatic control 200 to turn the blower motor 61 on and off and, in certain embodiments of the invention, to switch the blower 60 between a first speed and a second speed.

The thermostatic control 200 is further electrically connected to the gas valve 100, via wires 15. It is this connection which permits the thermostatic control 200 to ensure that gas is available from the gas valve 100 to the gas outlet pipe 104 and the pilot outlet pipe 102 only when desired.

Figure 2B:
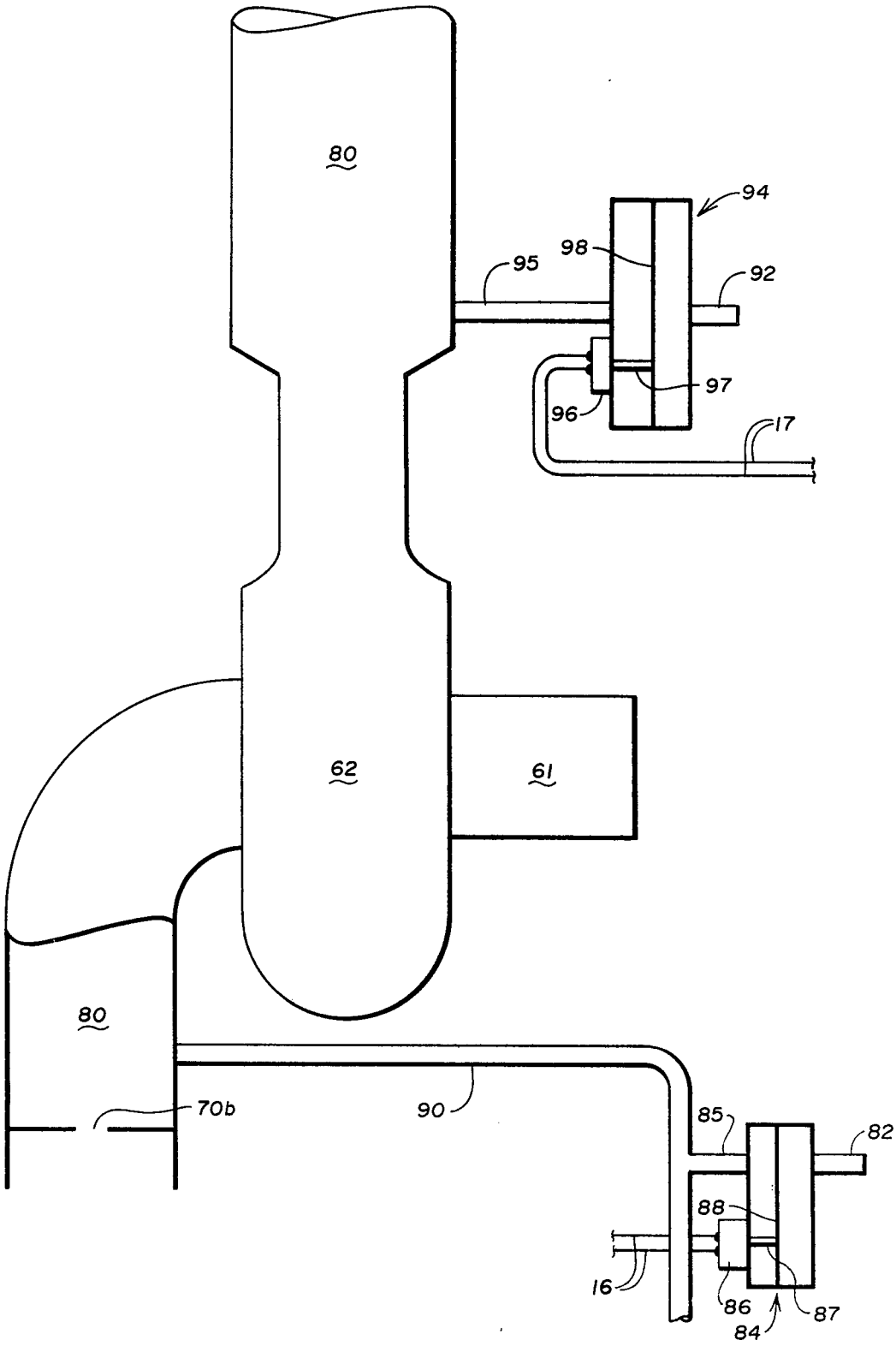
FIG. 2*b* is a detail of the induced draft blower, exhaust stack and pressure sensing components of the invention shown in FIG. 1, as modified to use an orifice upstream from the blower and negative pressure feedback.

A still further electrical connection to the thermostatic control 200 comes from a second differential pressure sensor 94, via wires 17. As seen in FIGS. 1, 2*a* and 2*b*, one input to the second differential pressure sensor 94 is provided by a conduit 95 which connects one side of the differential pressure sensor 94 to a pressure region in the exhaust stack 80 downstream from both the blower 60 and the orifices 70 or 70*b*. The pressure in this region will hereinafter be referred to as the "stack exit pressure." The second input to the second differential pressure sensor 94 is atmospheric reference pressure via the conduit 92. As in the first differential sensor 84, the second sensor 94 has a diaphragm 98 which actuates a rod 97 to trip a switch 96, electrically connected to the thermostatic control 200. The function of this arrangement, as explained in greater detail below, is to detect dangerous blocked stack conditions, which are characterized by elevated stack exit pressures.

The fan 34 which circulates air through the heat exchanger 30 is provided with power by line voltage connections 11 and 12. The fan motor 38 (FIGS. 4, 5; not shown in FIG. 1) is electrically connected, via wires 18, to a fan limit control switch 56 which is driven by a temperature sensitive element 57, such as a bimetal thermostat. This temperature sensitive element 57 causes the fan motor 38 to be switched on when the air temperature in the heat exchanger 30 rises above a predetermined temperature (fanstart setpoint) and to be switched off when the temperature of the air in the heat exchanger 30 sinks below a predetermined temperature (fan-stop setpoint). To minimize condensation in the heat exchanger, the fan-start setpoint is chosen substantially at or somewhat above the dewpoint. One suitable temperature sensitive switch for this purpose is the L4064 fan and limit switch manufactured by Honeywell, Inc., of Minneapolis, Minnesota. Because one purpose of the fan limit control switch 56 is to delay fan start-up until the heat exchanger 30 contains air at or above the dewpoint, a time-delay mechanism could be substituted for the temperature sensitive element 57. This mechanism could be activated at the same time as the blower motor 61, but it would delay fan start-up for a predetermined period sufficient to let the heat exchanger 30 reach the dewpoint temperature.

An additional feature of the invention which is shown in FIG. 1 is the pilot gas bleed conduit 106 which is used to flush out the pressure feedback conduit 90 and which is connected to the pilot outlet pipe 102. The gas flow path which includes the pilot gas bleed conduit 106 is limited by a relatively small orifice, e.g. a small tap hole 107 (FIG. 3*a*) connecting to the pilot outlet pipe 102. Accordingly, this path conveys a small amount of fuel gas, tapped from the pilot outlet pipe 102 (and therefore at line gas pressure) to the pressure feedback conduit 90, joining it in the vicinity of its connection to the stack 80.

b. Modulating Gas Valve

Figure 3A:
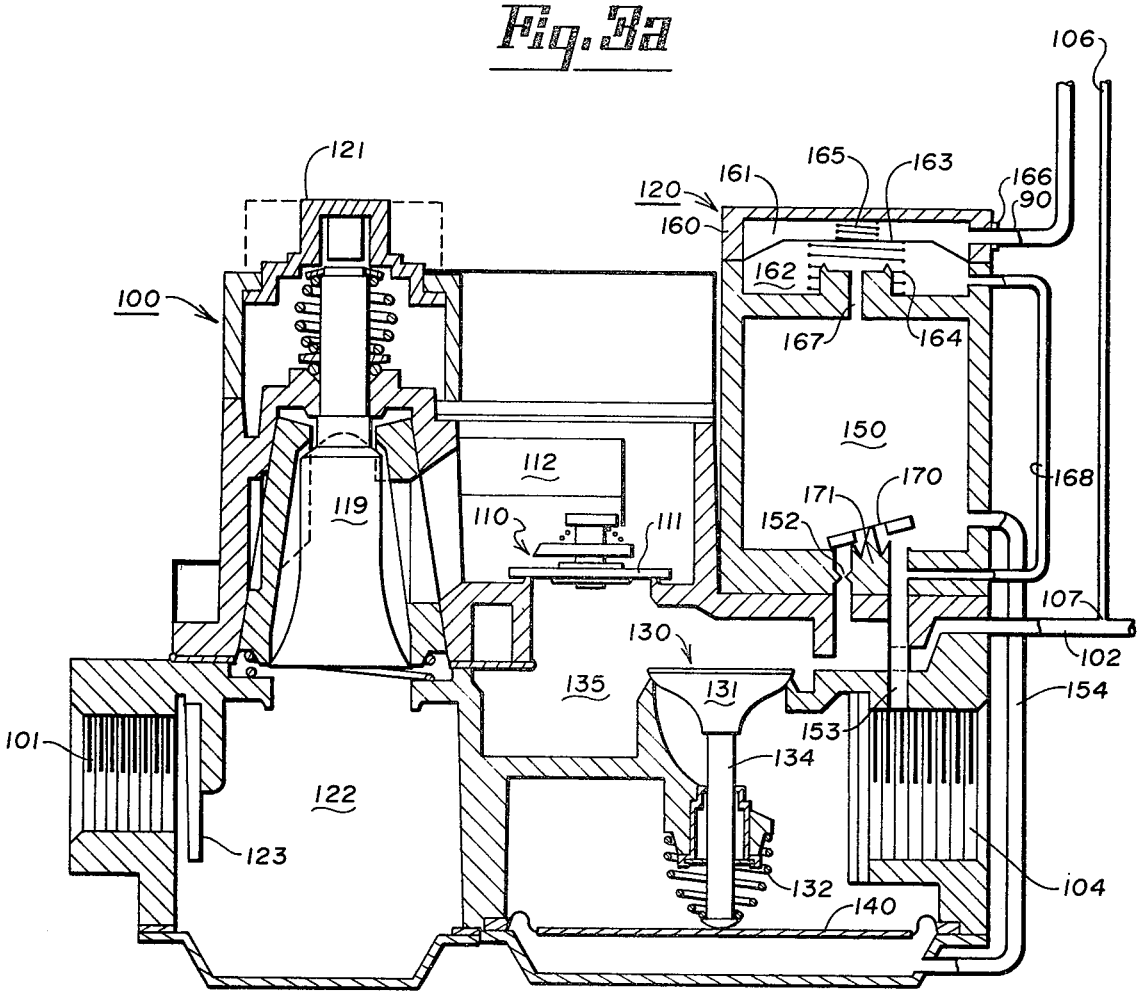
FIG. 3*a* is a schematic diagram of the modulating gas valve used in the present invention shown in the "off" position.
Figure 3B:
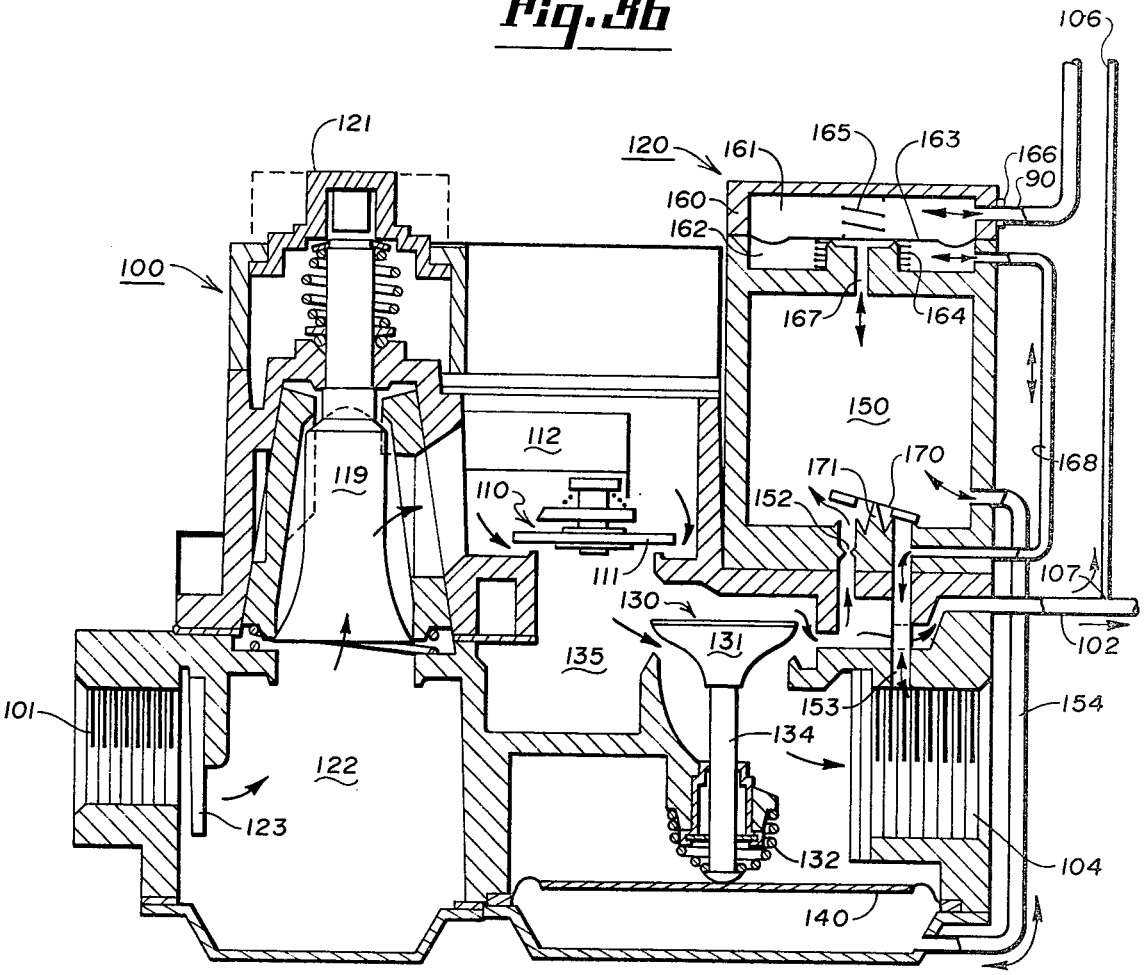
FIG. 3*b* is a schematic diagram of the modulating gas valve used in the present invention shown in the "on" position.

Schematically shown in FIGS. 3*a* and 3*b*, is the detailed structure of the preferred embodiment of the pressure modulating gas valve 100, including its connections to various other parts of the furnace system. In the preferred embodiment, this valve is a redundant, modulating gas valve, such as the Model VR 860 valve manufactured by Honeywell, Inc. with its conventional configuration adapted to receive a feedback pressure signal in the upper portion of its servo pressure regulator chamber. Referring now to FIG. 3*a*, which shows the gas valve 100 in the "off" position, it is seen that the fuel gas supply (at line pressure, typically 7 to 10 inches W.C.) enters the valve 100 via a gas inlet pipe 101, while the pressure-regulated outlet gas leaves the valve to flow to the burner 40 through the outlet pipe 104. The gas valve 100 is made up of several components. These can generally be divided into a first main valve 110, a second main valve 130 and a regulator valve section 120. The first main valve 110 opens and closes by means of a valve disc 111 which is actuated by a solenoid mechanism 112. When this first main valve 110 is open (FIG. 3*b*), gas is permitted to flow into the region above the second main valve 130 and also to the pilot outlet pipe 102 and to the pilot gas bleed conduit 106.

The gas valve 100 has an inlet chamber 122, which is located below a manually-actuated on-off valve 119 controlled by the knob 121. Gas can enter the inlet chamber 122 by flowing under the dirt barrier 123 and upwards toward the first main valve 110. After passing the first main valve 110, the gas will enter the second main valve chamber 135, which contains a second main valve disc 131 mounted via a stem 134 on a second main valve spring 132, which biases the second main valve 130 into a closed position. The lower end of the stem 134 of the main valve disc 131 bears against a main valve diaphragm 140.

The regulator valve section 120 comprises an operator valve chamber 150 which accomodates a seesaw-like operator valve 170 actuated by a suitable electromagnetic actuator 171. Located above the operator valve chamber 150 is a servo pressure regulator chamber 160, divided into an upper portion 161 and a lower portion 162 by a regulator diaphragm 163. The regulator diaphragm 163 is balanced by opposing springs. The lower spring 164 exerts an upward force, and the upper spring 165 exerts a downward force, as viewed in FIGS. 3*a* and 3*b*.

Other important structural features of the regulator valve section 120 include a working gas supply orifice 152 in a conduit communicating between the operator valve chamber 150 and the chamber 135 above the second main valve 130. The feedback pressure conduit 90 is connected to the upper portion 161 of the regulator chamber 160 by means of a feedback connector fitting 166. Accordingly, the upper portion 161 of the regulator chamber 160 will contain the pressure sensed in the stack 80 and communicated back to the gas valve 100 by the conduit 90.

Figure 6:
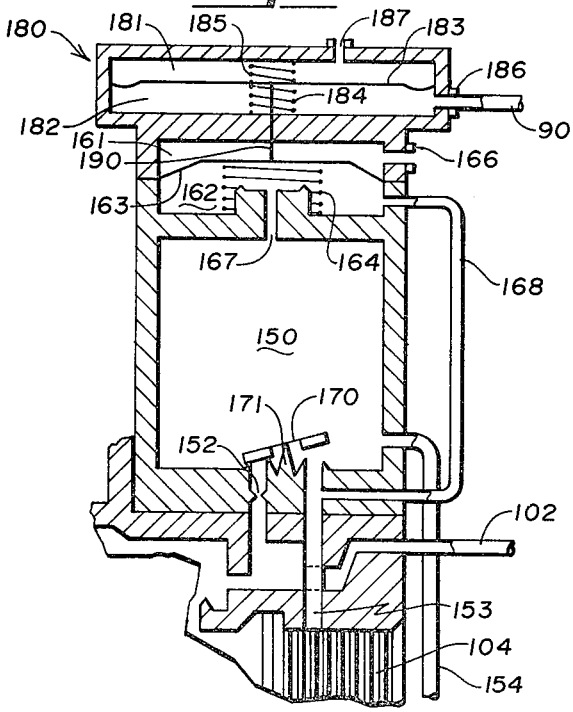
FIG. 6 is a schematic diagram of a portion of an alternate embodiment of the modulating gas valve used in the present invention as adapted for use with negative pressure feedback.

An alternative embodiment of the regulator valve section 120 is shown in FIG. 6. In this alternative embodiment an additional regulator diaphram chamber 180 is used to permit an amplified negative pressure feedback signal to be used for control. To accomplish this, the feedback pressure conduit 90 is no longer connected to the feedback connector fitting 166. Instead this fitting is left open so that the upper portion 161 of the regulator chamber 160 is exposed to atmospheric pressure. In addition, the upper diaphragm spring 165 is removed, and one end of a rod 190 is connected to the upper side of the regulator diaphragm 163. The other end of the rod 190 is connected to an amplifier diaphragm 183, which separates the additional regulator diaphragm chamber 180 into two portions 181, 182. The rod 190 is movably mounted by suitable sealing and bearing surfaces so that it moves up and down freely with the up and down motion of the amplifier diaphragm 183.

The position of amplifier diaphragm 183 is determined by the balance of forces bearing on it. These include the force of the opposing lower and upper springs 184, 185 and the pressures in the upper portion 181 and the lower portion 182 of the diaphragm chamber 180. Due to the open orifice 187, atmospheric pressure will prevail in the upper portion 181 of the diaphragm chamber 180. Because the feedback conduit 90 is connected to the lower portion 182 by means of the fitting 186, the lower portion 182 will contain the feedback pressure. It will readily be seen that the presence of a lower-than-atmospheric pressure in the lower portion 182 will move the amplifier diaphragm 183 downward from its spring-balanced rest position, causing the rod 190 to exert a downward force on the regulator diaphragm 163. Thus, a negative pressure in the lower portion 182 of the chamber 180 has generally the same effect as would a positive pressure in the upper portion 161 of the chamber 160. It will further be seen, however, that when the surface area of the amplifier diaphragm 183 is larger than the surface area of the regulator diaphragm 163, the force exerted on the diaphragm 163 via the rod 190 for any given negative pressure will be greater than the force which would be exerted on the diaphragm 163 if a positive pressure of the same magnitude were present in the upper portion 161 of the regulator chamber 160.

In connection with the negative pressure embodiment of the invention, it should also be noted that for this embodiment the differential pressure sensor 84 previously described must be modified so that it responds to a predetermined pressure differential, with the pressure communicated in the conduit 85 being a negative pressure rather than a positive pressure. For example, the switch 86 and actuator rod 87 could be moved to the other side of the sensor 84, as shown in FIG. 2*b*.

In connection with FIG. 6, it should also be noted that the additional regulator diaphragm chamber 180 can, if desired, be used in a positive pressure system by connecting the conduit 90, carrying a positive feedback pressure, to the orifice 187. Thus, the amplifying effect of the additional regulator diaphragm chamber 180 is also available for positive feedback pressure systems. In addition, in a control system in which it is desired to control gas flow based on a pressure differential, the desired pressures may be connected to orifices 186 and 187 respectively, such that true differential pressure regulation is achieved. For example, in certain applications it may be desirable to determine flow of stack gases by sensing pressure on both the upstream and downstream sides of the flow restricting orifice 70 or 70*b*, rather than sensing one stack pressure and an atmospheric reference pressure.

c. One-stage Control System

Figure 4:
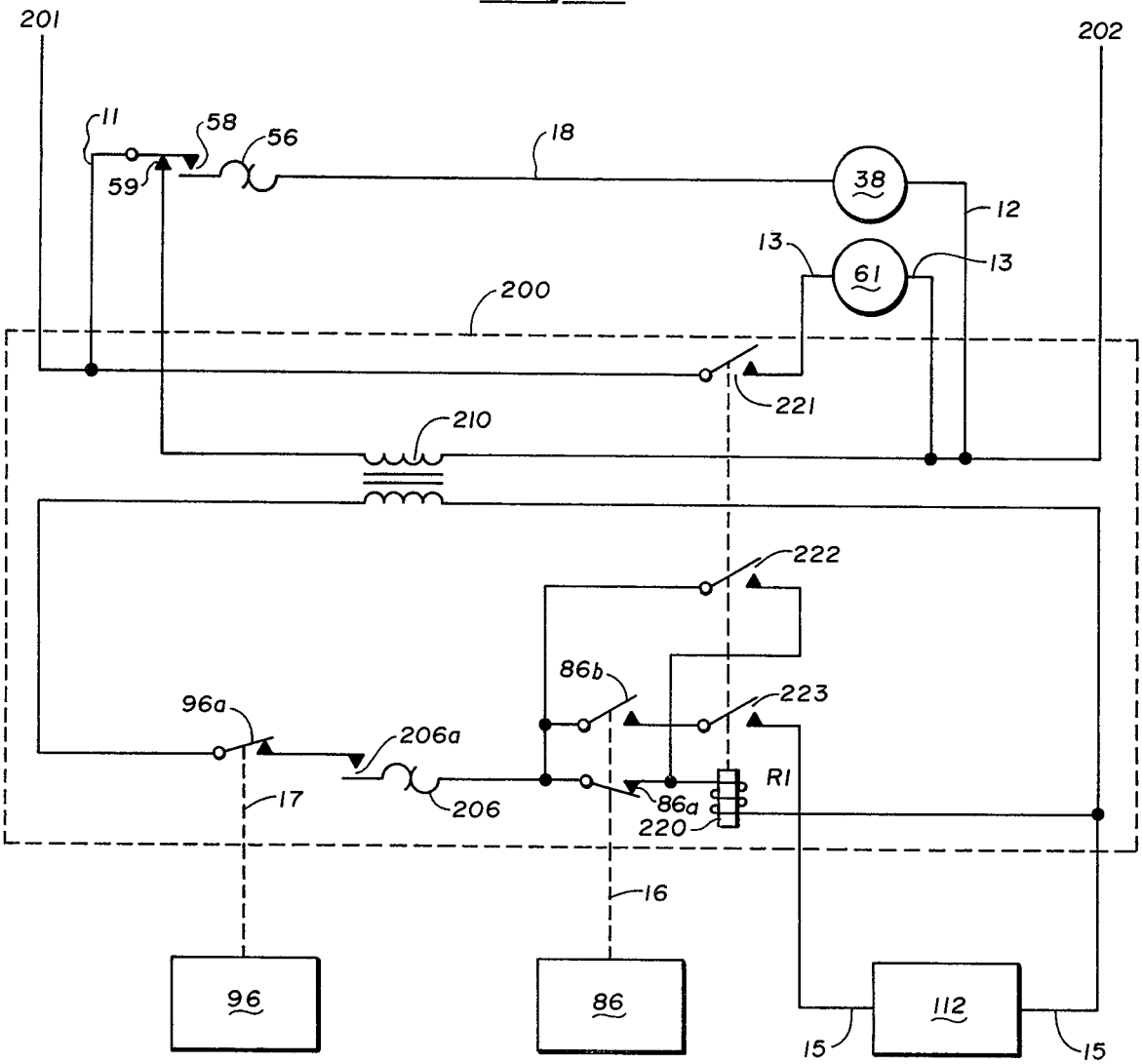
FIG. 4 is an electrical schematic of a one-stage thermostat control system used in connection with the present invention.

Shown in FIG. 4 is an electrical schematic of a one-stage thermostat control system for the present invention. This schematic illustrates the components which would be contained within the thermostatic control 200 and also those electrically connected thereto, such as the electric motors 38, 61, the fan control switch 56 and the differential pressure switches 86, 96. Power in the form of line voltage, e.g. 120 volts a.c., is provided to the control system via wires 201 and 202. This line voltage is also connected to the fan motor 38, via two wires 11, 12 and the normally open main contacts 58 of the fan limit control switch 56, and to the induced draft blower motor 61, via the wires 13 and the normally open relay contacts 221. The line voltage is stepped down to an appropriate thermostat voltage, e.g., 24 volts a.c., by a transformer 210.

The secondary voltage from the transformer 210 powers the R1 relay 220, which actuates normally open relay contacts 222 and 223, as well as the previously mentioned relay contacts 221 in series with the blower motor 61. A bimetal-mercury thermostat switch 206 (such as Honeywell, Inc. thermostat model T87) with contacts 206*a* is in series with all of the components connected to the secondary side of the transformer 210. Switch contacts 86*a* (normally closed), in series with the coil of the R1 relay 220, and switch contacts 86*b* (normally open), in series with the solenoid actuator 112 for the first main valve 110 (FIG. 3*a*), are actuated by the differential pressure switch 86. This switch is constructed such that when contacts 86*a* open, contacts 86*b* close, while when the contacts 86*b* close, contacts 86*a* open. The solenoid actuator 112 for the first main valve 110 is also connected in series with R1 relay contacts 223. This configuration constitutes a safe start feature (as further explained below), because each startup cycle requires that the differential pressure switch 86 go from its normal state (contacts 86*a* closed, contacts 86*b* open) to its switched state (contacts 86*a* open, contacts 86*b* closed). Should, for example, the contacts 86*a* be welded closed, the R1 relay 220 will be activated, but the actuator 112 will receive no current, because the contacts 86*b* will be kept open.

Additional elements of the one-stage control system are normally closed contacts 59, in series with the primary side of the transformer 210, and normally closed contacts 96*a*, in series with the secondary side of the transformer 210. Contacts 59 are opened by fan limit control switch 56 at a predetermined temperature (shutdown setpoint), corresponding to a dangerously high heat exchanger temperature. Contacts 96*a* are opened by the switch 96 when the differential pressure sensor 94 detects a high stack exit pressure, indicating a blocked stack.

d. Two-stage Control System

Figure 5:
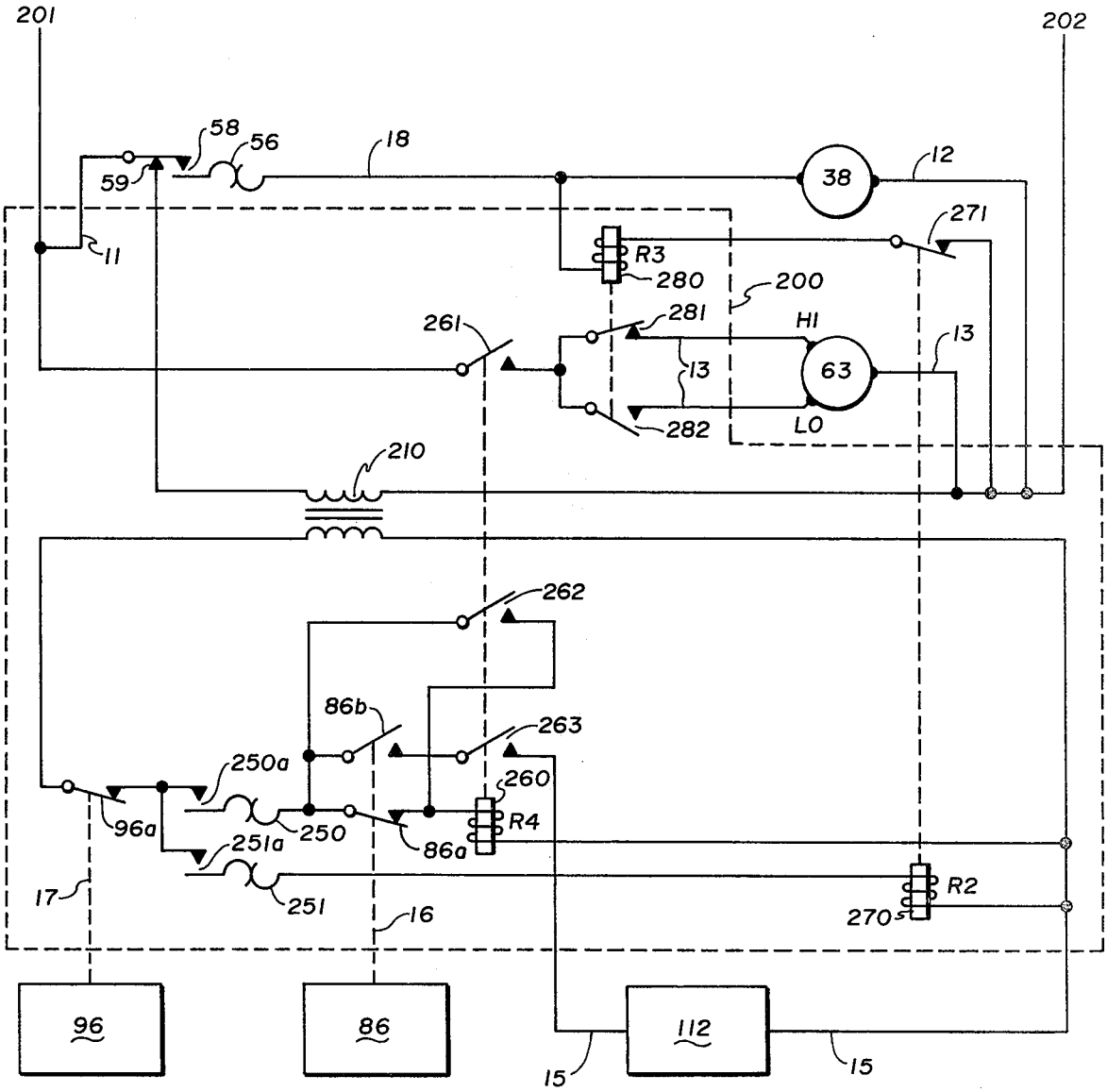
FIG. 5 is an electrical schematic of a two-stage thermostat control system used in connection with the present invention.

Shown in FIG. 5 is an alternate embodiment of the thermostatic control 200 associated with the present invention. In this embodiment the thermostatic control 200 has two stages, with two thermostat elements 250, 251 (such as in Honeywell, Inc. thermostat model T872F). As in the previously described, single-stage embodiment, line voltage power is provided on wires 201 and 202. This line voltage is used to power the fan motor 38, to which it is connected via two wires 11, 12 and the normally open main contacts 58 of the fan limit control switch 56. In an electrical path parallel to the fan motor 38 are the coil for the R3 relay 280 and a normally closed pair of contacts 271 actuated by the R2 relay 270. Also powered by the line voltage, via wires 13, is a two-speed draft blower motor 63 which, in this embodiment, is substituted for the single-speed induced draft blower motor 61 of the previously described embodiment. (Correspondingly, in FIG. 1 the pair of wires 13 would be replaced by three wires.) The parameters of the blower 60, including its effective flow rates at higher and lower speeds, are chosen so that the furnace will operate at substantially its design maximum when the blower motor 63 is on its higher speed. The lower speed of the blower motor 63 is chosen to produce a firing rate less than the design maximum for the furnace. Typically, the lower firing rate will be on the order of 50% to 70% of the design maximum.

Relay contacts 261 actuated by R4 relay 260 are in series with the blower motor 63. The high speed circuit to the blower 63 is controlled by normally closed contacts 281 actuated by R3 relay 280, while the low speed circuit for the blower 63 is controlled by normally open contacts 282, also actuated by R3 relay 280. The contacts 282 close when the contacts 281 open, and vice versa. Voltage at an appropriate level for the room thermostat portion of the control, in the preferred embodiment 24 volts a.c., is provided by the secondary of the transformer 210, which is powered on its primary side by line voltage.

As seen in FIG. 5, there are two different temperature-actuated circuits in parallel with the secondary side of the transformer 210. The first circuit is essentially the same as the single thermostat circuit of the previously-described single-stage embodiment. The bimetal-mercury thermostat element 250 with contacts 250*a* corresponds to the single stage thermostat element 206. Contacts 86*a* and 86*b*, activated by the differential pressure switch 86, are connected in series with the solenoid actuator 112 and with the coil of the R4 blower control relay 260 (which corresponds to the R1 relay 220 in the single-stage embodiment of FIG. 4), respectively. Contacts 261, 262 and 263 are driven by the R4 relay 260 and correspond to the R1 relay contacts 221, 222 and 223 of FIG. 4.

In the second temperature-actuated circuit connected in parallel to the secondary side of transformer 210 is a second bimetal-mercury thermostat element 251 with contacts 251*a*, which is connected in series with the coil for R2 relay 270, driving the normally-closed contacts 271. The bimetal element 251 is set to close its contacts at a slightly lower temperature (e.g. 2–3 degrees Fahrenheit) than the actuation temperature for the other bimetal element 250. As will be described in greater detail below, the function of this second temperature-actuated circuit is to switch the blower motor 63 between its higher and lower speeds under certain circumstances, by controlling the power to the coil of the R3 relay 280. The two-stage control system also includes contacts 59 and 96*a*, used in the same safety circuits as in the single-stage control system.

Operation of Preferred and Alternate Embodiments

The operation of the present invention can best be understood in terms of two interrelated sequences of operation. The first sequence of operation concerns the functioning of the modulating gas supply valve 100. This valve is designed to produce an outlet gas pressure which is modulated in accordance with the magnitude of a pressure signal sensed on one side of the stack orifice 70. In particular, the valve 100 is intended to produce an outlet gas pressure which is proportional to the magnitude of the pressure sensed in the region of the stack 80 near the blower 60 and stack orifice 70. In the preferred embodiment (FIGS. 1, 3*a* and 3*b*), this pressure is sensed and fed back to the gas valve 100 by means of a conduit 90, which at one end is connected to and through the wall of the exhaust stack 80 just upstream from the stack orifice 70. At its other end, the conduit 90 communicates with a fitting 166, which, in turn, leads into the upper portion 161 of the servo regulator chamber 160 of the gas supply valve 100.

It should be noted that although the preferred and alternate embodiments described have control systems which rely on a pressure feedback signal to control a gas supply pressure, this is only one way of approaching the objective of obtaining an air-fuel ratio approximating stoichiometric combustion. The molecular ratios of fuel and oxygen desired for stoichiometric combustion are translatable into mass ratios which correspond, in the case of moving fluids in a continous combustion process, to mass flow rates. Given the flow-restricting geometry of the gas valve 100 and the orifices 70 and 70*b*, the mass flow rates correspond to pressures measured adjacent the orifices. In particular, the greater the pressure differential across a flow-restricting orifice of a given size, the greater the mass flow through the orifice. In fact, mass flow is proportional to the square root of the pressure difference. For this reason, it is possible to use the relationship between pressures sensed at appropriate locations as a substitute for direct sensing of the relationship between mass flow rates. However, it should be clear that the present invention can be implemented by sensing parameters other than pressure, which also correspond to mass flow rates, and by using the sensed values to control fuel delivery rate parameters other than gas supply pressure, although the following discussion of operation specifically discusses a pressure-oriented control system.

a. Operation of Modulating Gas Valve

As best seen in FIG. 3*a*, showing the gas supply valve 100 in the "off" position, in normal operation there are several closure points which affect the flow of gas through the gas supply valve 100. The first main valve 110 is connected via the pipe 101 and the inlet chamber 122 to the external gas supply at line pressure and can, by itself, prevent gas from flowing into the remainder of the gas supply valve 100. Accordingly, opening of the first main valve 110 is a prerequisite to any flow of gas from the outlet pipe 104. Because other closure points in the valve 100 can also independently prevent flow of outlet gas, the type of valve used in the present invention can incorporate improved safety features and is termed "redundant." Several conditions must be met before the valve 100 permits gas to flow to the burner 40.

The first main valve 110 also controls the supply of gas to the pilot outlet pipe 102 and to the pilot gas bleed conduit 106 used in certain embodiments for flushing the feedback pressure conduit 90. Thus, the burner 40 has an intermittent pilot. Once the first main valve 110 is open, gas can flow into these two lines and also into the second main valve chamber 135.

Gas entering the gas supply valve 100 flows into the inlet chamber 122 and then flows under a dirt barrier 123, which is designed to deter foreign particles from entering the remainder of the valve. A knob 121 connected to a manually-actuated valve 119 located above the inlet chamber 122 can be used to manually open and close the flow of gas from the inlet chamber 122. This valve 119 is typically closed only in exceptional situations, not during normal operation. After passing under the dirt barrier 123 and through the first main valve 110, the gas flows into a chamber 135 located above the second main valve 130. From this chamber 135, the gas can flow to the pilot outlet pipe 106 and in one or two other directions. If the second main valve 130 is open, the gas can flow into a region above the main valve diaphragm 140 and into the outlet gas pipe 104. If the second main valve 130 is not open, the gas will tend to flow up through the working gas supply orifice 152 toward the operator valve chamber 150. This flow will be significantly restricted by the narrow orifice 152, across which there may exist a pressure gradient. However, no gas will enter the operator valve chamber 150 at all when the operator valve 170 closes the conduit which includes the orifice 152, as shown in FIG. 3*a*. Only when the operator valve 170 opens this conduit, as shown in FIG. 3*b*, can gas enter the operator valve chamber 150 from the chamber 135 and flow upward toward the servo pressure regulator chamber 160.

Gas will enter the lower portion 162 of the servo pressure regulator chamber 160 only when the regulator diaphragm 163 is not pressed down so as to sealingly engage the regulator orifice 167. When the orifice 167 is closed as shown in FIG. 3*b*, gas cannot enter the lower portion 162 of the servo pressure regulator 160, except from the outlet pipe 104, by means of the narrow conduit 168 (as discussed below). Once the orifice 167 is open, gas can flow between the operator valve chamber 150 and the lower portion 162 of the servo pressure regulator 160. Gas which enters the lower portion 162 of the servo pressure regulator chamber 160 can escape only via the conduit 168, which leads to the outlet gas pipe 104, or by flowing back into the operator valve chamber 150. It should be noted that the lower portion of the conduit 168 connects with a conduit 153, which communicates between the operator valve chamber 150 and the outlet gas pipe 104 when the operator valve 170 is in the "off" position (FIG. 3*a*). Accordingly, when the operator valve 170 is "off" as shown in FIG. 3*a*, gas can flow directly between the operator valve chamber 150 and the outlet gas pipe 104. However, when the operator valve 170 is in its "on" position, as shown in FIG. 3*b*, gas cannot flow directly between the operator valve chamber 150 and the outlet gas pipe 104. The position of the operator valve 170 does not, of course, directly limit the flow of gas between the lower portion 162 of the servo pressure regulator 160 and the outlet gas pipe 104 via the conduit 168, because it closes only one end of the conduit 153.

Gas which flows into the operator valve chamber 150 can also escape from this chamber into the conduit 154 which leads to the region below the main valve diaphragm 140. As can be seen best in FIG. 3*b*, gas pressure in the region below the main valve diaphragm 140 presses upward on the main valve diaphragm 140 against the force of the second main valve spring 132 to raise the second main valve disc 131. Because the surface area of the diaphragm 140 is relatively large, gas pressure in the region below the diaphragm 140 has a mechanical advantage as against the gas pressure in the chamber 135 when the second main valve 130, with its disc 131 of smaller surface area, is closed.

To regulate the outlet gas pressure to be proportional to the pressure which is communicated via the conduit 90 to the upper portion 161 of the servo pressure regulator 160, the various valve components function as follows in the preferred embodiment shown in FIGS. 1, 2*a*, 3*a* and 3*b*. Assuming that the burner 40 has been off for at least a short period of time and the first main valve 110 and the operator valve 170 have been closed, the various closure points will be as shown in FIG. 3*a*. This is because any excess (greater than atmospheric) pressure will have been dissipated from the outlet gas pipe 104 and thus from the area below the second main valve 130 and below the regulator diaphragm 163. Further, because the operator valve 170 has been in its "off" position, excess pressure in the operator valve chamber 150 and below the main valve diaphragm 140 will also have been dissipated. The same atmospheric pressure will thus exist above and below the main valve diaphragm 140, in the valve operator chamber 150 and in the region 162 below the regulator diaphragm 163. Accordingly, the second main valve 130 will be forced to its closed position by the spring 132 and by any excess pressure which may remain in the chamber 135.

Because the stack blower 60 has been off, the feedback conduit 90 and the region 161 above the regulator diaphragm 163 also contain atmospheric pressure and the regulator diaphragm 163 assumes its rest position, as determined by the balance of forces between the springs 164 and 165. The regulator diaphragm 163 is pushed away from the regulator orifice 167, because the spring 164 is selected (or adjusted by suitable screw adjustment means, not shown) such that the pressure in the upper portion 161 must exceed the pressure in the lower portion 162 by a given threshold pressure (0.2 inches W.C. in the preferred embodiment), before the regulator diaphragm 163 will close against the regulator orifice 167.

Assuming that the preceding conditions obtain, once the first main valve 110 permits gas to enter the chamber 135 above the closed second main valve 130, the gas can go no further (except to the pilot outlet pipe 102) until the operator valve 170 is opened. This will occur when its actuator 171 has been activated as a result of proof of pilot flame. (This can be done by a conventional ionized gas circuit as part of the intermittent pilot system and is not explained in further detail herein.) Upon opening of the operator valve 170, gas at line pressure flows through the orifice 152 into the operator valve chamber 150 and into the lower portion 162 of the regulator chamber 160. A small amount of gas will begin to flow into the outlet pipe 104 through the conduit 168. Gas also flows into the conduit 154 leading to the region under the main valve diaphragm 140. Pressure will begin to build in this region, tending to push the main valve diaphragm 140 upward. This gas pressure will, however, not significantly exceed the forces holding the second main valve 130 closed, because of the force of the spring 132, the high line pressure of the gas in the chamber 135 and the gas flow from the operator valve chamber 150 into the lower portion 162 of the regulator chamber 160 and out through the conduit 168.

Assuming that the blower 60 has been switched on (as explained below), as the speed of the blower 60 reaches its maximum, a feedback pressure will begin to build up upstream from the orifice 70 and be fed back to the upper portion 161 of the regulator chamber 160 via the conduit 90. When this feedback pressure exceeds the pressure below the regulator diaphragm 163 by a predetermined threshold value $P_t$, in the preferred embodiment 0.2 inches W.C., regulator orifice 167 will be closed by the diaphragm 163. The requirement of an excess pressure of 0.2 inches W.C. serves to prove blower operation. When the orifice 167 closes, this will cut off gas flow to the conduit 168, cause an increase in the pressure in the operator chamber 150, and cause the pressure below the main valve diaphragm 140 to increase. The main valve diaphragm 140 will be pushed upward, eventually forcing the second main valve 130 to open (FIG. 3*b*). This, in turn, will cause the pressure in the outlet pipe 104, to rise, which pressure is communicated up to the lower portion 162 of the regulator chamber 160 via the conduits 153 and 168. This rising pressure in the lower portion 162 of the regulator chamber 160 will eventually overcome the feedback pressure in the upper portion 161, to reopen the regulator orifice 167. This, in turn, causes the pressures in the operator valve chamber 150 and the area below the main valve diaphragm 140 to tend to decrease, which causes the second main valve 130 to tend to close and the outlet gas pressure and the pressure below the regulator diaphragm 163 to decrease. Because the lower spring 164 overcomes the upper spring 165 when the pressure below the regulator diaphragm 163 rises to within 0.2 inches W.C. of the pressure above the regulator diaphragm 163, while the spring 165 overcomes the spring 164 when the feedback pressure exceeds the pressure below the diaphragm 163 by more than 0.2 inches W.C., the outlet gas pressure ($P_o$) is regulated to be substantially equal to the feedback pressure ($P_f$), less 0.2 inches W.C. (the threshold pressure $P_t$). Thus, $P_o = P_f - 0.2 = P_f - P_t$, where all pressures are expressed in inches W.C. and are relative to atmospheric pressure.

b. Operation of Thermostat Control Systems

Referring now to FIG. 4, the second important sequence of operation for the thermostat control system, the operation of the electrical components for the one-stage control system, is described. In the following, reference will be made to the positive pressure embodiment of the invention, identified above as the preferred embodiment and shown in FIGS. 1 and 2*a*. The negative pressure embodiment shown, in part, in FIG. 2*b* will be discussed further below in connection with the operation of the alternate embodiment of the regulator valve section 120 shown in FIG. 6.

When the temperature in the heated space whose temperature is to be regulated sinks below the room temperature setpoint of the thermostatic control 200, the bimetal element 206 closes its contacts 206*a* to initiate a burning phase. Assuming that the differential pressure switch 86 is in its normal position, contacts 86*a* will be closed and contacts 86*b* open. The coil of R1 relay 220 will become energized, causing contacts 221, 222 and 223 to close. Thus, the blower motor 61 starts, and pressure begins to build in the stack 80 upstream from the orifice 70. When the feedback pressure exceeds atmospheric reference pressure by a predetermined amount, e.g., in the preferred embodiment, 0.85 inches W.C., the differential pressure switch 86 changes state, closing contacts 86*b* and opening contacts 86*a*. Sufficient combustion air for proper combustion is thus proved. The R1 relay coil 220 remains energized due to the closed contacts 222, and the solenoid 112 of the first main valve 110 is activated. Thus, the previously described operation sequence for the gas valve 100 commences. The pilot flame 41 gets gas and is ignited, causing the operator valve 170 to open. The regulator valve section 120 begins to regulate the outlet gas pressure to be proportional to the feedback pressure ($P_o = P_f - 0.2$), as previously described.

When the burner 40 lights and the temperature in the combustion chamber 20 and the heat exchanger 30 rises, this is detected by the temperature sensor 57 (FIG. 1) of the fan limit control switch 56. When the fan-start setpoint for this sensor 57 is reached, the fan motor 38 is energized via closing of the main contacts 58. Cold air will be drawn into the heat exchanger 30 and warmed air will be sent to the heated space.

The burning phase will continue until the heated space rises above the room temperature setpoint, causing the bimetal element 206 to open its contacts 206*a*. At this point the R1 relay coil 220 is deenergized, and the contacts 221, 222 and 223 are opened. The first main valve solenoid 112 loses power and cuts off the gas supply, and the stack blower motor 61 stops running. Because the now stationary blower fan blades 62 and the flow-limiting orifice 70 are in the flow path of the stack 80 (FIG. 1), they substantially inhibit further draft flow up the stack 80. Thus, the heat stored in the heat exchanger 30 is conserved. The fan motor 38 will continue to run until the bimetal sensor 57 of the fan limit control switch 56 reaches its fan-stop setpoint, causing the main contacts 58 to open. If at any time during burner operation, the pressure differential sensed by the sensor 84 drops below the predetermined value at which the switch 86 changes state (corresponding to a decreased stack flow rate and an undesirably low firing rate), the RI relay coil 220 will be deenergized to cut off the gas supply.

Accordingly, it will be seen that the present invention as controlled by a one-stage thermostatic control system, operates with feedback-controlled fuel-gas pressure and with a flow-limiting orifice 70 and an induced draft blower 60, which allow draft flow, with its consequent heat loss, only during the burning phase. It will also be seen that by judicious choice of the capacity of blower 60, the size of orifice 70 and the parameters of the burner 40, the furnace of the present invention may be operated throughout its burning phase at a firing rate somewhat less than the design maximum, to further increase efficiency. For example, significant efficiency increases can be obtained by derating a furnace to 80% of its design maximum, at the expense of somewhat longer delays to reach the room temperature setpoint and possibly inability to achieve setpoint under heaviest heating loads. Because blower speed and draft flow affect the amount of combustion air drawn into the combustion chamber 20 and, because they affect the gas supply flow by means of pressure feedback, the system also provides control over the air-gas ratio at the selected firing rate, despite minor variations which may occur in draft flow. It will further be seen that the present invention is also adaptable to conventional, natural draft furnaces in which the geometry of the flue and natural draft opening still permit substantial control of draft flow by means of an induced draft blower. Thus, the present invention may be used in retrofit applications on such furnaces.

Referring now to FIG. 5, the sequence of operation of the alternate control system embodiment, incorporating two-stage thermostatic control and providing a higher and a lower firing rate, is described. When the temperature of the heated space sinks below the setpoint of the thermostat element 250 with the higher setpoint, the contacts 250*a* close and the coil of R4 relay 260 is activated via normally closed contacts 86*a*, thereby causing the contacts 261, 262 and 263 to close. Because the R3 relay 280 is not active at this point (the main contacts 58 of fan limit control switch 56 are open), the R3 relay contacts 281 are closed and the twospeed blower motor 63 comes on at high speed, corresponding to the higher firing rate of the furnace. Pressure begins to build in the stack 80 upstream from the orifice 70. As in the single-stage embodiment, when the upstream pressure exceeds the atmospheric reference pressure by a predetermined amount, the differential pressure switch 86 changes state, closing contacts 86*b* and opening contacts 86*a*, to activate the solenoid 112 of the first main valve 110. Thus, the previously described operations sequence for the gas valve 100 commences. The pilot flame 41 gets gas and is ignited. The regulator valve section 120 begins to regulate the outlet gas pressure to be proportional to the feedback pressure ($P_o = P_f - 0.2$), as previously described.

As the burner 40 lights and the temperature in the combustion chamber 20 and the heat exchanger 30 rises, this is sensed by the temperature sensor 57 (FIG. 1) of the fan limit control switch 56. When the fan-start setpoint for this sensor is reached, the fan motor 38 is energized via the now closed contacts 58. This also energizes the R3 relay 280, causing contacts 281 to open and contacts 282 to close. This switches the blower motor 63 to low speed, corresponding to the lower or derated firing rate, in the preferred embodiment, 50% to 70% of the higher firing rate, and the burning phase continues. When the temperature in the heated space rises to the setpoint of the thermostat element 250, its contacts open and the blower motor 63 and the solenoid 112 are both deenergized. Shutdown of the fan motor 38 follows later as in the single-stage embodiment.

Should the temperature in the heated space at any time drop below the setpoint of the thermostat element 251, then the contacts 251*a* will close and the R2 relay 270 will be activated. If this occurs when the R3 relay 280 is activated (contacts 282 closed; lower firing rate), it will cause the R3 relay to be deactivated (contacts 281 closed; higher firing rate). That is, if the blower motor 63 is operating at low speed, activation of thermostat element 251 will switch it to high speed. If the R2 relay 270 is activated when the R3 relay 280 is not activated, no change in blower speed will occur. If a burning phase begins with both thermostat elements 250, 251 activated, then the R2 relay 270 will be activated and the system will not switch to the lower firing rate when the fan motor 38 is turned on. Only when the thermostat element 251 with the lower setpoint is satisfied, will the system be able to switch to the lower firing rate.

In cases where the furnace is substantially derated for its lower speed, a slight modification of the differential pressure sensor 84 may be required for proper operation of the two-stage thermostatic control system. If the lower blower speed results in a decrease in the feedback pressure (or suction, in the case of a negative pressure system) such that the pressure differential required to trip switch 86 is not achieved, then the sensor 84 must be modified by decreasing the required pressure differential to a lower value, e.g. 0.25 inches W.C., to avoid burner shutdown when the blower motor 63 switches to its lower speed.

Accordingly, it will be seen that the present invention, as controlled by a two-stage thermostatic control system, operates with a two-speed induced draft blower and feedback controlled fuel-gas pressure to produce a furnace with a higher and a lower firing rate. As with the singlestage system, off-cycle losses are reduced by the presence of the blower 60 and the orifice 70 in the stack 80. In addition, substantial derating can be achieved for a significant portion of the burning phase because the system switches to a lower firing rate after start-up. However, because the system always starts at the higher firing rate and maintains this rate until the heat exchanger 30 reaches a predetermined temperature either substantially at or somewhat above the dewpoint, there is no substantial increase in condensation, which might decrease furnace life. In addition, the two-stage control system permits the furnace to stay at the higher firing rate when necessary to achieve desired temperatures under heavy heating load or to speed recovery from a period of temperature setback, such as at night.

c. Operation of Negative Pressure Embodiment

Referring now to FIGS. 2*b*, 3*a*, 3*b* and 6, operation of the negative pressure embodiment of the invention can be described. The operation sequence of the gas valve 100 for this embodiment is substantially the same as described above with respect to the positive pressure embodiments, with the exception of the regulator valve section 120. The additional regulator diaphragm chamber 180 which is shown in FIG. 6 permits the regulator diaphragm 163 to be influenced by a negative pressure in the lower portion 182 of the regulator diaphragm chamber 180, rather than by a positive pressure in the upper portion 161 of the diaphragm chamber 160.

Before the first main valve 110 opens, the regulator diaphragm 163 and the amplifier diaphragm 183 are in their rest position. For the regulator diaphragm 163, this means that it is positioned away from the regulator orifice 167 so that this orifice is open. For the amplifier diaphragm 183, the rest position is selected, by means of the springs 164, 184 and 185 and the length of the rod 190, such that in the rest position the rod 190 does not force the regulator diaphragm 163 against the orifice 167. Thus, in this embodiment atmospheric pressure in the lower portion 182 of the chamber 180 is designed to produce the same regulator valve configuration as atmospheric pressure in the upper portion 161 of the chamber 160 produces in the positive pressure embodiment of the valve 100, shown in FIG. 3*a*.

Operation of the valve 100, modified as shown in FIG. 6 to receive a negative pressure feedback signal, follows the same sequence as for positive pressure feedback, once the first main valve 110 opens. At this point, the second main valve 130 begins to open and the regulator diaphragm 163 is urged upward by the pressure in the chamber 150. In the negative pressure embodiment, however, there is no positive pressure in the region above the regulator diaphragm 163 to urge it downward. Instead, a negative, or lower-than-atmospheric, pressure is fed back to the valve 100. As shown in FIG. 2*b*, in this embodiment the feedback conduit 90 is connected downstream from an orifice 70*b* located upstream from the blower fan 62 which draws combustion products through the flow limiting orifice 70*b* to exit to the atmosphere. Thus, the region between the orifice 70*b* and the fan 62 is being evacuated. This causes a pressure drop across the orifice 70*b* followed by a pressure rise across the fan 62. Specifically, the negative pressure produced between the orifice 70*b* and the fan 62 is fed back to the lower portion 182 of the regulator chamber 180 which supplements the regulator valve section 120 in this embodiment. This negative pressure tends to draw the diaphragm 183 downward and, by means of the rod 190, to move the diaphragm 163 downward also. The geometry of these parts is chosen such that the diaphragm 163 can be driven down far enough to close the orifice 167. In this manner the negative pressure in the lower portion 182 of the chamber 180 is used to produce the same general regulating effect as would a positive pressure in the upper portion 161 of the chamber 160. In fact, by appropriate selection of the springs 164, 184 and 185 and by giving the diaphragm 183 the same area as the diaphragm 163, virtually the same relationship between gas outlet pressure and the feedback pressure can be developed as in the positive pressure embodiment, namely $P_o = P_{f-} - P_t$, where $P_{f-}$ is the absolute value of the difference between atmospheric pressure and the feedback pressure, expressed in inches W.C. The remainder of the equation is as defined previously.

The negative pressure embodiment of the gas valve 100 has two important distinctions as compared to the positive pressure embodiment. First, by varying the relative sizes of the amplifier diaphragm 183 and the regulator diaphragm 163 the ratio of $P_o$ to $P_{f-}$ can take on values other than unity. Because the force exerted on the diaphragm 163 through the rod 190 depends on both the pressure $P_{f-}$ and the area of the amplifier diaphragm 183, the influence of a given negative pressure can be multiplied as compared to the influence that a positive pressure of the same magnitude would have in the regulator chamber 160. For example, if the amplifier diaphragm 183 is made larger than the regulator diaphragm 163 (as shown in FIG. 6), the above equation becomes $P_o = KP_{f-} - P_t$ where K is a constant greater than 1. If the amplifier diaphragm is made smaller, K is less than 1. The capability of varying the value of K gives the negative pressure control system greater flexibility in the design of the control equipment for regulating the air-fuel ratio.

The second distinction between the negative and positive pressure control systems is with respect to the problem of condensation in the feedback conduit 90 and the chambers connected thereto. The relatively high water vapor content of combustion products in the stack 80 makes condensation likely in any chamber where these gases collect, especially as the gases cool. With positive pressure feedback some combustion products will enter and collect in the conduit 90 and in the upper portion 161 of the chamber 160, unless some form of flushing is used (see below). With negative pressure feedback, on the other hand, gas will tend to flow out of the conduit 90 and into the stack 80. If a small air leak exists in the conduit 90, this may cause sufficient flow into the stack 80 to keep any combustion products from diffusing into the conduit 90. In fact, to ensure the existence of such flow, a small controlled air leak (not shown) can be introduced in the conduit 90 or the lower portion 182 of the diaphragm section 180 to which it connects. Thus, the conduit 90 flushes itself with air automatically whenever the blower 60 is operating. No fuel gas flushing is necessary.

The remainder of the control system to be used with the negative pressure embodiment of the valve 100 is the same as is shown in FIG. 4 (one-stage control) and in FIG. 5 (two-stage control), with the exception of the differential pressure sensors 84 and 94. As noted above, for the negative pressure situation the switch 86 is modified so that it changes state when the pressure in the conduits 85 and 90 is at a predetermined level below atmospheric reference pressure, rather than at a predetermined level above atmospheric pressure. When this pressure differential is sensed, the switching of contacts 86*a* and 86*b* occurs as in the positive pressure situation. Again, the purpose is proof of adequate combustion air for proper combustion (i.e., minimum firing rate detection). As to differential pressure sensor 94, this sensor becomes redundant because the sensor 84 can now detect a blocked stack condition. With the negative pressure embodiment, a blocked stack will decrease the pressure drop across the orifice 70*b*. When the pressure differential sensed by the sensor 84 becomes too small, the switch 86 changes state, opening contacts 86*b* and closing contacts 86*a*. Gas will be shut off. Otherwise, the operation sequences of the circuitry shown in FIGS. 4 and 5 is the same for positive or negative feedback pressures and the description of operation need not be repeated.

d. Operation of Additional Features

An important safety feature of the present invention is performed by the second differential pressure sensor 94, best seen in FIGS. 1, 2*a* and 2*b*. When the stack blower 60 is operating normally, the stack exit pressure, as measured downstream from both the blower fan 62 and the orifice 70 (70*b* in the alternate embodiment), should always remain substantially the same as atmospheric pressure. Under these conditions, the burner 40 should be permitted to turn on and off normally. However, should the stack 80 become blocked downstream from its connection to the conduit 95, a dangerous condition may arise and the burner 40 should not be used. In the present invention, the differential pressure sensor 94 and its associated switch 96, with contacts 96*a* (FIGS. 4 and 5), detect a blocked stack condition and ensure that the burner 40 will be shut down or not allowed to start a burning phase. This occurs as follows.

As described previously, the differential pressure sensor 94 and its associated switch 96 are designed such that the contacts 96*a* are normally closed. This state of the contacts exists whenever the stack exit pressure does not exceed the atmospheric pressure by more than a predetermined amount, e.g. 0.25 inches W.C. When the stack exit pressure exceeds atmospheric pressure by more than 0.25 inches W.C., the contacts 96*a* will open to totally cut off power from the secondary side of the transformer 210. The immediate effect of this is to deactivate the solenoid 112 to cut off the gas supply. As noted above, this safety feature is redundant in the case of a negative pressure system, but it is equally applicable for this system.

Among the enhancements or variations of the preferred and alternative embodiments of the present invention are certain additional safety features. For example, the temperature sensor 57 may include a third, danger-condition, setpoint, at a temperature level higher than its setpoint to turn the fan 34 on and off, and second normally-closed contacts 59, actuated by the sensor 57 and placed in series with the primary side of the transformer 210, as shown in FIG. 4 and 5. The danger-condition setpoint is chosen such that an abnormally high heat exchanger temperature can be detected. When such a temperature is detected, the second, normally-closed contacts 59 are opened, cutting power to the primary side of the transformer 210, and the system is shut off. This avoids dangers caused by continued burning with an abnormally high heat-exchanger temperature.

A second additional safety feature which can be incorporated in the present control system is a pressure sensor which detects low outlet gas pressure, a condition which can sometimes lead to abnormal combustion in the burner 40. This low gas pressure sensor would sense pressure in the gas outlet pipe 104, and would only be enabled once a normal burning phase had started, so that it would not interfere with start-up. Activation of the low gas pressure sensor would cause the gas to be shut off and the rest of the system to be shut down normally, by a mechanism similar to that used in the case of stack blockage.

Another desirable feature of the present invention is illustrated in FIGS. 1, 2*a*, 3*a* and 3*b*, which show a means for flushing the feedback conduit 90. Because in the positive pressure embodiment of the invention the conduit 90 is connected to a region in the stack 80 containing an elevated pressure, the combustion products in this region would tend to diffuse into the conduit 90 and the upper portion 161 of the regulator chamber 160. Eventually these combustion products, which contain about 10% water vapor, could cause condensation and could cause corrosion and, perhaps, disturbance of the pressure feedback path. To avoid this undesirable situation, the present invention would employ a very small flow of fuel gas from the gas valve 100 through the pressure feedback conduit 90 into the stack 80.

To obtain the desired small flow of gas, the pilot gas outlet pipe 102 is tapped by a pilot gas bleed conduit 106, as seen best in FIGS. 3*a* and 3*b*. The other end of the pilot gas bleed conduit 106 is connected to and communicates with the feedback pressure conduit 90 at some point in close proximity to the connection of the feedback conduit 90 to the stack 80. This location for the connection to the feedback conduit 90 is chosen in order to reduce problems which may occur when the conduit 90 becomes blocked. If the block occurs between the bleed conduit connection point and gas valve 100, flushing gas will still flow into the stack 80. On the other hand, if the block occurs between the bleed conduit connection point and the stack 80, gas from the bleed conduit 106 will be driven into the upper portion 161 of the chamber 160. This could cause an abnormal increase in outlet gas pressure. Accordingly, the bleed conduit connection point is chosen to minimize the length of the more vulnerable portion of the conduit 90.

Because the gas tapped from the pilot gas outlet 102 is at line pressure, which is always higher than the outlet gas pressure, which, in turn, is always less than the positive feedback pressure, the gas pressure in the pilot gas bleed conduit 106 will sufficiently oppose the pressure in the feedback line 90. Flushing gas will diffuse into the pressure region upstream from the orifice 70, rather than combustion products diffusing out of this region. By choosing a very small size for the tap hole 107 into the pilot gas outlet pipe 102 and/or for the inner diameter of the pilot gas bleed conduit 106, any effect of the flushing gas on the pressure in the feedback conduit 90 can be kept negligible, and the actual flow of such gas into the upstream pressure region can be kept low. A very limited flow of gas through the pilot gas bleed conduit 106 is also desirable from a cost point of view and to avoid any significant addition of combustible material to the hot combustion products in the stack 80. If, for example, the flushing path is limited with an orifice the size of a No. 80 drill, and if the pressure in the pilot gas outlet pipe 102 exceeds the feedback gas pressure by approximately 6 inches W.C., it is estimated that flushing could be achieved with a maximum cost of approximately 520 cubic feet of gas annually.

It will be obvious to one skilled in the art that a number of modifications can be made to the above-described preferred embodiments without essentially changing the invention. For example, it is clear that other modulating gas valve designs could be used which perform essentially the same control function. Various solid-state sensors and switching devices may be substituted for the bimetal thermostatic elements and the contacts and relays shown. It is also clear that the feedback pressure signal representing stack gas flow may be transmitted by other means, such as mechanical or electrical arrangements, and that data other then pressure which have the desired correspondence with stack gas flow rates, may be used in the feedback loop. Moreover, the induced draft blower and stack gas flow feedback concept could be adapted to various other kinds of heating systems, using other fuels, in which derating and regulating mass flow rates of the combustion input materials can affect system efficiency. One skilled in the art would also realize that the present invention can be used as a design for retrofitting existing furnaces, including natural draft furnaces, or as a design for the manufacture of new furnaces. Accordingly, while the preferred and alternative embodiments of the invention have been illustrated and described, it is to be understood that the invention is not limited to the precise constructions herein disclosed, and the right is reserved to all changes and modifications coming within the scope of the invention as defined in the appended claims.

Having thus described the invention, what is claimed as new, and desired to be secured by Letters Patent, is:

1. In a heating system having a combustion chamber with a fuel burner and an exhaust stack, the improvement comprising:

a blower connected to the exhaust stack for inducing a draft in the exhaust stack and drawing air into the combustion chamber;

means adapted to be mounted in the exhaust stack for forming a flow restriction in the exhaust stack on one side of the blower;

fuel supply control means adapted to control the supply of fuel to the burner responsive to a control signal representative of mass flow in the exhaust stack to supply fuel at a rate proportional to the magnitude of the control signal;

means for sensing a quantity representative of mass flow in the exhaust stack through the flow restriction means and for communicating said sensed quantity as a control signal to the fuel supply control means;

blower control means adapted for connection to the blower for starting and stopping operation of the blower;

wherein the fuel is a gas, said fuel supply control means is responsive to a gas pressure signal and said means for sensing and communicating a sensed quantity as a control signal comprises a conduit which connects the fuel supply control means to a region of the exhaust stack on one side of the flow restriction means and communicates the gas pressure in this region to the fuel supply control means;

wherein the conduit is connected to a region of the exhaust stack which is on the upstream side of the flow restriction means; and further comprising means for introducing a small flow of flushing gas into said conduit at a point along its length, said flushing gas being at a pressure higher than the pressure communicated by said conduit so as to prevent any substantial diffusion of combustion products from said exhaust stack through said conduit.

2. The heating system as recited in claim 1 wherein said point at which the flushing gas is introduced is in close proximity to the connection of the conduit to said region of said exhaust stack.

3. The heating system as recited in claim 1 wherein the heating system has a pilot gas supply and said small flow of flushing gas is tapped from the pilot gas supply.

4. In a heating system having a combustion chamber with a fuel burner and an exhaust stack, the improvement comprising:

a blower connected to the exhaust stack for inducing a draft in the exhaust stack and drawing air into the combustion chamber;

means adapted to be mounted in the exhaust stack for forming a flow restriction in the exhaust stack on one side of the blower;

fuel supply control means adapted to control the supply of fuel to the burner responsive to a control signal representative of mass flow in the exhaust stack to supply fuel at a rate proportional to the magnitude of the control signal;

means for sensing a quantity representative of mass flow in the exhaust stack through the flow restriction means and for communicating said sensed quantity as a control signal to the fuel supply control means;

blower control means adapted for connection to the blower for starting and stopping operation of the blower;

wherein the fuel is a gas, said fuel supply control means is responsive to a gas pressure signal and said means for sensing and communicating a sensed quantity as a control signal comprises a conduit which connects the fuel supply control means to a region of the exhaust stack on one side of the flow restriction means and communicates the gas pressure in this region to the fuel supply control means;

wherein the flow restriction means is located on the upstream side of the blower and the conduit is connected to a region of the exhaust stack which is between the flow restriction means and the blower; and further comprising means for introducing a small flow of flushing gas into said conduit at a point along its length.

5. The heating system as recited in claim 4 wherein the means for introducing a small flow of flushing gas comprises a controlled air leak introduced in said conduit.

6. In a heating system having a combustion chamber with a fuel burner and an exhaust stack, the improvement comprising:

a blower connected to the exhaust stack for inducing a draft in the exhaust stack and drawing air into the combustion chamber;

means adapted to be mounted in the exhaust stack for forming a flow restriction in the exhaust stack on one side of the blower;

fuel supply control means adapted to control the supply of fuel to the burner responsive to a control signal representative of mass flow in the exhaust stack to supply fuel at a rate proportional to the magnitude of the control signal;

means for sensing a quantity representative of mass flow in the exhaust stack through the flow restriction means and for communicating said sensed quantity as a control signal to the fuel supply control means;

blower control means adapted for connection to the blower for starting and stopping operation of the blower;

wherein the fuel is a gas, said fuel supply control means is responsive to a gas pressure signal and said means for sensing and communicating a sensed quantity as a control signal comprises a conduit which connects the fuel supply control means to a region of the exhaust stack on one side of the flow restriction means and communicates the gas pressure in this region to the fuel supply control means; and further comprising means for sensing atmospheric pressure, means for comparing the atmospheric pressure to the pressure communicated to the fuel supply control means and means for enabling fuel flow to the burner when the difference between the pressure communicated to the fuel supply control means and atmospheric pressure exceeds a predetermined value.

7. In a heating system having a combustion chamber with a fuel burner and an exhaust stack, the improvement comprising:

a blower connected to the exhaust stack for inducing a draft in the exhaust stack and drawing air into the combustion chamber;

means adapted to be mounted in the exhaust stack for forming a flow restriction in the exhaust stack on one side of the blower;

fuel supply control means adapted to control the supply of fuel to the burner responsive to a control signal representative of mass flow in the exhaust stack to supply fuel at a rate proportional to the magnitude of the control signal;

means for sensing a quantity representative of mass flow in the exhaust stack through the flow restriction means and for communicating said sensed quantity as a control signal to the fuel supply control means;

blower control means adapted for connection to the blower for starting and stopping operation of the blower; and further comprising means for determining whether said quantity representing mass flow in the exhaust stack exceeds a predetermined value and means for enabling fuel supply to the burner when the predetermined value is exceeded.

8. In a heating system having a combustion chamber with a fuel burner and an exhaust stack, the improvement comprising:

a blower connected to the exhaust stack for inducing a draft in the exhaust stack and drawing air into the combustion chamber;

means adapted to be mounted in the exhaust stack for forming a flow restriction in the exhaust stack on one side of the blower;

fuel supply control means adapted to control the supply of fuel to the burner responsive to a control signal representative of mass flow in the exhaust stack to supply fuel at a rate proportional to the magnitude of the control signal;

means for sensing a quantity representative of mass flow in the exhaust stack through the flow restriction means and for communicating said sensed quantity as a control signal to the fuel supply control means;

blower control means adapted for connection to the blower for starting and stopping operation of the blower; and further comprising means for determining whether said quantity representing mass flow in the exhaust stack exceeds a predetermined value and means for disabling fuel supply to the burner when the predetermined value is not exceeded.

9. In a heating system having a combustion chamber with a fuel burner and an exhaust stack, the improvement comprising:

a blower connected to the exhaust stack for inducing a draft in the exhaust stack and drawing air into the combustion chamber;

means adapted to be mounted in the exhaust stack for forming a flow restriction in the exhaust stack on one side of the blower;

fuel supply control means adapted to control the supply of fuel to the burner responsive to a control signal representative of mass flow in the exhaust stack to supply fuel at a rate proportional to the magnitude of the control signal;

means for sensing a quantity representative of mass flow in the exhaust stack through the flow restriction means and for communicating said sensed quantity as a control signal to the fuel supply control means;

blower control means adapted for connection to the blower for starting and stopping operation of the blower; and wherein said fuel supply control means further includes means for sensing pressure in the exhaust stack downstream from the blower and the flow restriction means, means for sensing atmospheric pressure and means for shutting off the supply of fuel when the sensed pressure in the exhaust stack exceeds atmospheric pressure by a predetermined amount.

10. In a heating system having a combustion chamber with a fuel burner and an exhaust stack, the improvement comprising:

a blower connected to the exhaust stack for inducing a draft in the exhaust stack and drawing air into the combustion chamber;

means adapted to be mounted in the exhaust stack for forming a flow restriction in the exhaust stack on one side of the blower;

fuel supply control means adapted to control the supply of fuel to the burner responsive to a control signal representative of mass flow in the exhaust stack to supply fuel at a rate proportional to the magnitude of the control signal;

means for sensing a quantity representative of mass flow in the exhaust stack through the flow restriction means and for communicating said sensed quantity as a control signal to the fuel supply control means;

blower control means adapted for connection to the blower for starting and stopping operation of the blower;

wherein said blower is operable at a plurality of higher and lower flow rates and said blower control means is effective to operate said blower at each of said plurality of flow rates, whereby said heating system is operable at a plurality of firing rates;

wherein said heating system further includes a heat exchanger and means for sensing the temperature in the heat exchanger and said blower control means is effective to start blower operation at a first, higher flow rate and to switch blower operation to a second, lower flow rate when a predetermined temperature not substantially less than the dewpoint is sensed in said heat exchanger; and wherein said first, higher flow rate causes the heating system to operate at substantially its design maximum firing rate and said second, lower flow rate causes the heating system to operate at a firing rate which is less than the design maximum firing rate.

11. In a heating system having a combustion chamber with a fuel burner and an exhaust stack, the improvement comprising:

a blower connected to the exhaust stack for inducing a draft in the exhaust stack and drawing air into the combustion chamber;

means adapted to be mounted in the exhaust stack for forming a flow restriction in the exhaust stack on one side of the blower;

fuel supply control means adapted to control the supply of fuel to the burner responsive to a control signal representative of mass flow in the exhaust stack to supply fuel at a rate proportional to the magnitude of the control signal;

means for sensing a quantity representative of mass flow in the exhaust stack through the flow restriction means and for communicating said sensed quantity as a control signal to the fuel supply control means;

blower control means adapted for connection to the blower for starting and stopping operation of the blower;

wherein said blower is operable at a plurality of higher and lower flow rates and said blower control means is effective to operate said blower at each of said plurality of flow rates, whereby said heating system is operable at a plurality of firing rates;

wherein said heating system further includes a heat exchanger and means for sensing the temperature in the heat exchanger and said blower control means is effective to start blower operation at a first, higher flow rate and to switch blower operation to a second, lower flow rate when a predetermined temperature not substantially less than the dewpoint is sensed in said heat exchanger; and wherein the blower control means further includes means for determining a temperature setpoint for a space heated by the heating system, means for sensing temperature in the heated space, and means for inhibiting switching of the blower to its second, lower flow rate when the temperature sensed in the heated space is less than the temperature setpoint for the heated space by a predetermined amount.

12. In a heating system having a combustion chamber with a fuel burner and an exhaust stack, the improvement comprising:

a blower connected to the exhaust stack for inducing a draft in the exhaust stack and drawing air into the combustion chamber;

means adapted to be mounted in the exhaust stack for forming a flow restriction in the exhaust stack on one side of the blower;

fuel supply control means adapted to control the supply of fuel to the burner responsive to a control signal representative of mass flow in the exhaust stack to supply fuel at a rate proportional to the magnitude of the control signal;

means for sensing a quantity representative of mass flow in the exhaust stack through the flow restriction means and for communicating said sensed quantity as a control signal to the fuel supply control means;

blower control means adapted for connection to the blower for starting and stopping operation of the blower;

wherein said blower is operable at a plurality of higher and lower flow rates and said blower control means is effective to operate said blower at each of said plurality of flow rates, whereby said heating system is operable at a plurality of firing rates;

wherein said heating system further includes a heat exchanger and means for sensing the temperature in the heat exchanger and said blower control means is effective to start blower operation at a first, higher flow rate and to switch blower operation to a second, lower flow rate when a predetermined temperature not substantially less than the dewpoint is sensed in said heat exchanger; and wherein the blower control means further includes means for determining a temperature setpoint for a space heated by the heating system, means for sensing temperature in the heated space and means for switching the blower from its second, lower flow rate to its first, higher flow rate when the temperature sensed in the heated space is less than the temperature setpoint for the heated space by a predetermined amount.

* * * * *